United States Patent [19]

Lücke et al.

[11] 4,233,676

[45] Nov. 11, 1980

[54] MIXING MECHANISM FOR A MIXING MACHINE

[75] Inventors: Roland Lücke; Eberhard Lipp, both of Paderborn, Fed. Rep. of Germany

[73] Assignee: Gebruder Lodige Maschinenbau GmbH, Paderborn, Fed. Rep. of Germany

[21] Appl. No.: 5,863

[22] Filed: Jan. 23, 1979

[30] Foreign Application Priority Data

Feb. 24, 1978 [DE] Fed. Rep. of Germany ..... 2802876

[51] Int. Cl.[3] ..... B01F 15/06

[52] U.S. Cl. ..... 366/147

[58] Field of Search ..... 366/144, 147, 145, 148, 366/149

[56] References Cited

U.S. PATENT DOCUMENTS

| | | | |
|---|---|---|---|
| 1,673,085 | 6/1928 | Loomis . | |
| 2,027,185 | 1/1936 | Loomis | 366/147 |
| 2,679,385 | 5/1954 | Lodige . | |
| 3,020,025 | 2/1962 | O'Mara | 366/147 |
| 3,285,330 | 11/1966 | Root | 366/147 |
| 4,058,907 | 11/1977 | Paderborn . | |
| 4,143,975 | 3/1979 | Lodige | 366/147 |

*Primary Examiner*—Robert W. Jenkins

*Attorney, Agent, or Firm*—Pearne, Gordon, Sessions, McCoy & Granger

[57] ABSTRACT

A mixing mechanism for a mixing machine, the mechanism comprising a shaft which is rotatably mounted in a cylindrical or partly cylindrical container of the mixing machine. On the shaft are radially extending arms each of which carries a mixing tool at its outer end. At least some of the arms and their respective mixing tools are each provided with a plate-like extension on the rear side as viewed in the rotational direction of the mixing mechanism.

7 Claims, 1 Drawing Figure

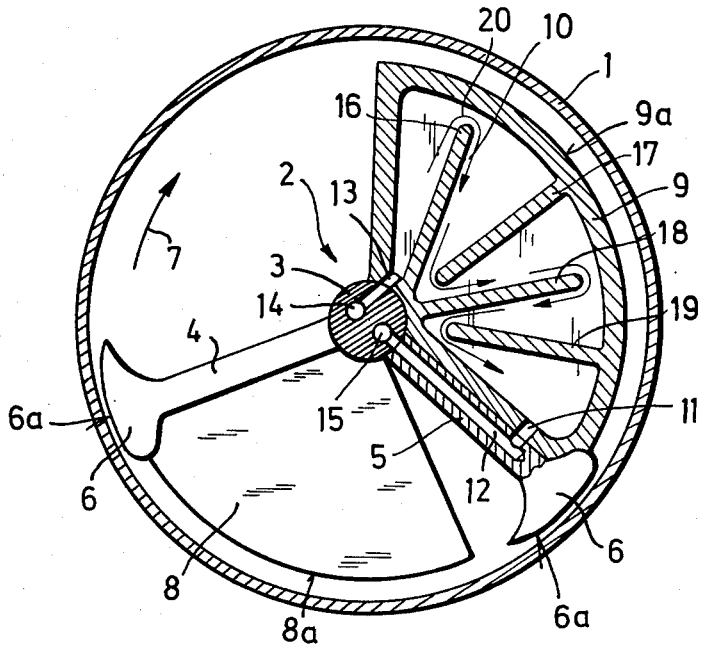
20
10
1
16
9a
17
2
13
9
18
7
3
14
19
4
6a
15
11
5
12
6
6
8
6a
8a

MIXING MECHANISM FOR A MIXING MACHINE

FIELD OF THE INVENTION

The invention relates to a mixing mechanism for a mixing machine, the mechanism having a shaft rotatably mounted in a cylindrical or partly cylindrical container of the mixing machine. The shaft carries radially extending arms each of which has a mixing tool at its outer end.

BACKGROUND OF THE INVENTION

In known mixing machines, the arms of the mixing mechanism, which may for example, be spirally distributed on the shaft, are so arranged that the mixing tools, which may, for example be of ploughshare form, can brush over the entire internal wall of the cylindrical container without being obstructed on the opposite side. The mixing tools passing successively, so to speak, in a specific sequence through the material to be mixed which is located in the mixing container thoroughly mix the material and also convey it in a predetermined direction in the mixing container, for example to the outlet located at one end. Depending upon the adjustment of the mixing tools or the arrangement of their lateral flanks, the conveying action of the mixing tools is greater or lesser and the residence time of the material being mixed in the mixing container is correspondingly shorter or longer. If the material is worked in batches, the residence time of the material being mixed in the mixing container can be adjusted more accurately because the mixing container is simply kept closed until the desired residence time has expired. However, if a continuous process is used in which material being mixed is continuously introduced into the mixing container at one end and delivered from the mixing container at the other end, the residence time cannot be so easily controlled. Instead, it is frequently difficult to attain a sufficiently long residence time of the material being mixed using only the agency of the mixing mechanism, for example by design and/or adjustment of the mixing tools.

In order to increase the residence time of the material being mixed in the mixing container of continuously operating mixing machine, it is known incorporate annular discs acting as shutters in the mixing container or to suspend partitions extending partly across the cross-section of the container. These discs or shutters counteract conveying of the material being mixed to the outlet end if it is too rapid. The suspended partitions can also be used for guiding heating or cooling media if they are made hollow and are connected to a system in which a heating or cooling medium circulates. These known means of increasing the residence time of the material being mixed in continuously operating mixing machines and for heating or cooling the material being mixed are relatively complicated and have the additional disadvantage of complicating the installation and dismantling of the mixing mechanism. The position of these additional fittings must also be determined and maintained very precisely so that it is not possible for them to collide with the mixing tools revolving between them.

It is also known to fix heatable or coolable discs on the shaft of the mixing tool between the mixing tools. It is possible to achieve a heat exchange surface which is as large as possible in the smallest space with an arrangement of this type, but there is the disadvantage of the difficulty in moving the material being mixed using the mixing tools located in the region of the periphery of the discs, which results in poorer mixing and degradation. Furthermore, a mixing mechanism of this type cannot be used for heterogeneous mixing operations with solid-liquid or solid-gaseous phases, and, the axial conveying of the material being mixed by means of the mixing tools is also impaired very considerably.

SUMMARY OF THE INVENTION

The object of the invention is to provide a mixing mechanism for a mixing machine and in particularly designed for a continuously operating mixing machine which, by simple means, ensures a sufficiently long, but not too long, residence time of the material being mixed in the mixing container and which is also capable of heating or cooling the material being mixed if necessary.

According to the invention there is provided a mixing mechanism for a mixing machine, comprising a shaft rotatably mounted in an at least partly cylindrical container of the said machine, arms extending radially outwardly from an inner end thereof connected to the shaft to an outer end thereof, mixing tools mounted on the said outer ends of the arms, and plate-like extensions mounted on the rear sides, as viewed in the rotational direction of the mixing mechanism, of at least some of the arms.

These plate-like extensions, which are preferably segmental in shape, of individual or even all arms and mixing tools of the mixing mechanism are located, so to speak, in the lee of the mixing tools and pass through the material being mixed behind the mixing tools when the mixing tools revolve. There must not therefore be any fittings in the form of discs, annular discs or plates in the mixing container and/or on the mixing mechanism shaft between the adjacent mixing tools so that the mixing tools do not operate against immediately adjacent impact surfaces either, in which case at least a proportion of their conveying action would be lost. Since the adjacent mixing tools are staggered relative to each other on the shaft of the mixing mechanism, the arrangement of the mixing tools and the size of the plate-like extensions mounted on them, can be selected in such a way that they lie at least in part in the trajectory of adjacent mixing tools, so that the material being mixed, which is conveyed laterally by the individual mixing tools, initially impinges once, at least in part, on to a plate-like extension of an adjacent mixing tool and so that its conveying energy is not increased. In this way, the material being mixed is conveyed through the mixing container from mixing tool to mixing tool in sections, so to speak, so that a predetermined minimum residence time is ensured for all particles in the material being mixed and individual particles of material being mixed are prevented from being conveyed through the mixing container more rapidly than others and degradation of the material being mixed is consequently prevented.

If the plate-like extensions of the arms and mixing tools may be hollow, so that heating media or cooling media can be guided through them. This enables optimum contact to be made between the material being mixed and the heating or cooling surface because the material being mixed is repeatedly thrown by the mixing tools against the extensions used for heating or cooling purposes which, in addition, pass through the mass of the material to be mixed lying on the bottom of the mixing container.

The plate-like extensions can be adapted in size to the mixing problems expected at any time. For example, the plate-like extensions and the corresponding mixing tools can be so arranged that the material being mixed which is conveyed laterally by a mixing tool does not impinge upon the extension of the immediately adjacent mixing tool but, for example, impinges only on the extension of the following mixing tool in order not to impair the mixing effect too much.

In any case, the plate-shaped extension must not form a complete disc, but must only extend over a proportion of the cross-sectional area of the mixing mechanism so that a proportion of the cross-sectional area always remains free for the unobstructed conveying of the material being mixed, even if these free sections are offset relative to each other so that only a type of cascade conveying is achieved. A substantially uniform and ideal residence time of the material being mixed in the mixing container is obtained in this way.

The segment-shaped extensions must not therefore be too large and, in particular, must not form complete or almost complete discs. Moreover, they must not be too small, i.e. they must have a predetermined minimum length or minimum surface area. In most cases, at least two fifths of the cross-sectional area of the mixing container can be occupied by the extension without adversely affecting the trajectory of the adjacent mixing tools.

Although the plate-like extensions are preferably fixedly mounted and thus non-interchangeable, it is also possible to make them adjustable in order to be able to alter the surface area thereof in order to change the residence time of the material being mixed in the mixing container.

In order to be able to use the extensions for heating or cooling purposes, the extensions may be at least partially hollow, the cavities therein being connected to a circulation system for heating or cooling media leading through the shaft of the mixing mechanism. The cavity in the plate-shaped extensions can have an inlet and an outlet which lead into the respective arm or into the shaft of the mixing tool. This ensures the circulation of heating or cooling medium through the hollow extensions, the shaft preferably containing separate passages for the supply and discharge of the heating or cooling medium. If the cavity is larger, then it is advantageous to provide guide elements such as guiding surfaces therein, which guide the heating or cooling medium as it flows through in such a way that it passes over the surfaces of the extensions substantially uniformly and thus heats or cools substantially uniformly.

BRIEF DESCRIPTION OF THE DRAWING

The drawing shows diagrammatically a cross-section through a mixing mechanism according to the invention which is fitted in a cylindrical container of a mixing machine.

DETAILED DESCRIPTION OF PREFERRED EMBODIMENT

The drawing shows a cylindrical container 1 of a mixing machine and a mixing mechanism 2 therefor. The remainder of the mixing machine may be conventional and is therefore not illustrated here. The mixing mechanism 2 has a shaft 3 which extends along the longitudinal axis of the container 1, and on which a plurality of radially extending arms 4 and 5 are fixed. Each of these arms 4 and 5 supports at its outer end a ploughshare-shaped mixing tool 6 with concave, convex, or flat working surfaces. The mixing tools 6 are shown as being integral with the respective arms 4 and 5, but can alternatively be fixed to the respective arm in any way, for example detachably mounted, if desired.

The mixing mechanism 2 is rotated in the direction of the arrow 7. A plate-like extension 8 or 9 is fixed behind each arm 4 or 5 and the corresponding mixing tool 6, as viewed in the rotational direction, these extensions being in the shape of segments of a circle in the embodiment illustrated and also being fixed on the shaft 3. These plate-like extensions 8 and 9 are preferably narrower than the arms and the mixing tools. The extensions 8 and 9 should at all events have the same width as the respective arms 4 and 5.

Although the extension 8 is in the form of a solid plate, while the extension 9 is a flat hollow body with a cavity 10 covering a large part of its surface area. This cavity 10 communicates via a passage 11 with an axial passage 12 in the arm 5 and via another passage 13 with a duct 14 located in the shaft 3. The axial passage 12 in the arm 5 is joined to a duct 15 located in the shaft 3 so that heating or cooling medium can be circulated through the cavity 10 via the ducts 14 and 15. Radially extending cross-members 16,17,18 and 19 are arranged in the cavity 10 to serve as guide elements and are arranged in such a way that the heating or cooling medium flows through the cavity along a labyrinthine path, as indicated by the arrow 20.

The arms 4 and 5 are not arranged in the same cross-sectional plane of the mixing mechanism but are offset relative to each other both in the longitudinal direction of the shaft 3 and in the circumferential direction, the other arms of the mixing mechanism (not shown) being arranged in a similar manner, i.e. being mounted on a helical line running round the shaft 3. The extensions 8 and 9 are consequently offset relative to each other so that they always cover the axial passage through the container 1 only partly, and the material being mixed can thus be conveyed through the mixing container in the manner of a cascade since it repeatedly accumulates for a short while upstream of an individual extension but can pass on once the respective extension is moved out of the conveying region during rotation of the mixing mechanism. Since individual extensions 8 or 9 are always located in the conveying region although always in different positions as viewed in the longitudinal direction of the container 1, the residence time of the material being mixed in the container 1 is longer than in the case of mixing without fittings obstructing the axial conveying of the material being mixed through the mixing container, but is shorter than in the case of known mixers with shutter-like or disc-shaped fittings fixed on the internal wall of the mixing container or on the shaft of the mixing mechanism. The residence time of the material being mixed in the container 1 can be determined very precisely beforehand by consideration of the surface area of the extensions 8 and 9 so that an optimum residence time for the respective material being mixed can be adjusted. Since most mixers are invariably used for rather similar materials to be mixed, it is sufficient to determine the surface area of the extensions 8 and 9 during the production of the mixing mechanism, but the surface area of the extensions 8 and 9 can also be changed, for example, by forming the extension of two parts which can be inserted into each other telescopically and can be fixed in different positions relative to each other.

Solid plate-shaped extensions 8 are used if only the residence time of the material being mixed in the container 1 is to be controlled while extensions 9 in the form of hollow bodies are used if a heating or cooling effect is additionally or mainly desired. It is usual to provide only one or other type of extensions 8 or 9 on a mixing mechanism, i.e. it is not normal to use solid and hollow extensions together, as shown adjacent to each other in the embodiment illustrated, on one and the same mixing mechanism.

The outer edge 8*a* and 9*a* of the segment-shaped extensions 8 and 9 is close to the internal wall of the container 1 but lies at a greater distance from the internal wall of the container 1 than the outer edge 6*a* of the mixing tools 6.

We claim:

1. A mixing mechanism for a mixing machine, comprising a shaft rotatably mounted in an at least partly cylindrical container of the said machine, arms extending radially outwardly from an inner end thereof connected to the shaft to an outer end thereof, mixing tools mounted on the said outer ends of the arms, and plate-like extensions mounted on the rear sides, as viewed in the rotational direction of the mixing mechanism, of at least some of the arms, said mixing tools and extensions being disposed in a helical arrangement relative to said shaft wherein the mixing tools and extensions of adjacent arms are axially spaced and angularly offset from one another, said mixing tools being constructed and arranged upon rotation of said shaft to stepwise axially convey a material being mixed between adjacent extensions with the material being impinged upon the extensions, and at least one of said extensions having a cavity therein which communicates with a circulation system leading through the shaft for circulating a heating or cooling medium, said cavity having an inlet and an outlet which lead into the respective arm or shaft.

2. A mixing mechanism according to claim 1, wherein each extension is segmental in shape.

3. A mixing mechanism according to claim 2, wherein each of said extensions has a radial dimension substantially equal to that of said container.

4. A mixing mechanism according to claim 1, wherein said cylindrical container provides an axial passageway therethrough for material to be mixed and said extensions are also constructed and arranged upon rotation of said shaft to continuously partially intersect said axial passageway and thereby to impose a predetermined residence time upon material being mixed as it is conveyed along said axial passageway by said mixing tools.

5. A mixing mechanism according to claims 1 or 4, wherein each of said extensions has a cross-sectional area equal to at least two-fifths of the cross-sectional area of said container.

6. A mixing mechanism for a mixing machine, comprising a shaft rotatably mounted in an at least partly cylindrical container of the said machine, arms extending radially outwardly from an inner end thereof connected to the shaft to an outer end thereof, mixing tools mounted on the said outer ends of the arms, and plate-like extensions mounted on the rear sides, as viewed in the rotational direction of the mixing mechanism, of at least some of the arms, at least one of the extensions having a cavity therein which communicates with a circulation system leading through the shaft for circulating a heating or cooling medium, said cavity having an inlet and an outlet which lead into the respective arm or shaft and containing guide elements for the heating or cooling medium flowing therethrough.

7. A mixing mechanism according to claim 6, wherein each extension is segmental in shape.

* * * * *